US008018177B2

(12) United States Patent
Goo et al.

(10) Patent No.: US 8,018,177 B2
(45) Date of Patent: Sep. 13, 2011

(54) DIMMING BUCK TYPE LED DRIVING APPARATUS

(75) Inventors: Bon Ahm Goo, Seoul (KR); Byoung Own Min, Gyunggi-do (KR); Young Jin Lee, Seoul (KR); Chang Woo Ha, Gyunggi-do (KR); Jeong In Cheon, Seoul (KR)

(73) Assignees: Samsung Electro-Mechanics Co., Ltd., Gyunggi-do (KR); Samsung LED Co., Ltd., Gyunggi-do (KR)

( * ) Notice: Subject to any disclaimer, the term of this patent is extended or adjusted under 35 U.S.C. 154(b) by 634 days.

(21) Appl. No.: 12/213,809

(22) Filed: Jun. 25, 2008

(65) Prior Publication Data

US 2009/0322247 A1 Dec. 31, 2009

(30) Foreign Application Priority Data

Jun. 26, 2007 (KR) ..... 10-2007-0063096

(51) Int. Cl.
*H05B 41/36* (2006.01)

(52) U.S. Cl. ..... 315/291; 315/209 R; 315/224; 315/225; 315/246; 315/307; 323/313

(58) Field of Classification Search ..... 315/209 R, 315/224, 225, 246, 247, 291, 307; 323/313
See application file for complete search history.

(56) References Cited

U.S. PATENT DOCUMENTS

| | | | | |
|---|---|---|---|---|
| 3,868,546 | A * | 2/1975 | Gilbreath et al. | 315/293 |
| 7,759,881 | B1 * | 7/2010 | Melanson | 315/307 |
| 2006/0170373 | A1 * | 8/2006 | Yang | 315/209 R |
| 2009/0315473 | A1 * | 12/2009 | Tsai et al. | 315/291 |

FOREIGN PATENT DOCUMENTS

KR 10-2004-0003220 A 1/2004

* cited by examiner

*Primary Examiner* — Douglas W Owens
*Assistant Examiner* — Thai Pham
(74) *Attorney, Agent, or Firm* — McDermott Will & Emery LLP

(57) ABSTRACT

A dimming buck type light emitting diode (LED) driving apparatus includes a main switch controlling a driving current flowing into an LED; a current detector detecting a driving current flowing into the LED; a power level determination unit determining a level of the driving power; a dimming capacitor for dimming control; a dimming control unit controlling charging and discharging of the dimming capacitor according to a power level determination signal and an enable signal; a reset circuit unit generating a reset signal according to a detection voltage from the current detector and a voltage of the dimming capacitor; a pulse generation unit generating a pulse signal; and a latch set by the pulse signal of the pulse generation unit and reset by the reset signal of the reset circuit unit to generate a switching signal, and turning on and off the main switch using the switching signal.

10 Claims, 3 Drawing Sheets

DIMMING BUCK TYPE LED DRIVING APPARATUS

CROSS-REFERENCE TO RELATED APPLICATIONS

This application claims the priority of Korean Patent Application No. 2007-63096 filed on Jun. 26, 2007, in the Korean Intellectual Property Office, the disclosure of which is incorporated herein by reference.

BACKGROUND OF THE INVENTION

1. Field of the Invention

The present invention relates to a dimming buck type light emitting diode (LED) driving apparatus, and more particularly, to a dimming buck type LED driving apparatus capable of realizing a dimming function of an LED by gradually increasing driving power when power supply is started and gradually decreasing the driving power when the power supply is cut off.

2. Description of the Related Art

In general, as application techniques of light emitting diodes (LEDs) are developed, LED driving techniques are also being developed gradually. Since applications of the LED are expanded, an LED driving technique is drawing much attention, which can realize a dimming function in the LED by gradually turning the LED on and off as in lighting in theater.

To implement the dimming function in the LED, an external device controller such as a pulse-width modulation (PWM) integrated circuit (IC) or a micom is used in the related art.

As mentioned above, since a separate IC for dimming such as the external device controller is additionally used for the dimming function of the LED, the size and power consumption of the entire device undesirably increase.

SUMMARY OF THE INVENTION

An aspect of the present invention provides a dimming buck type LED driving apparatus capable of realizing a dimming function of an LED by gradually increasing driving power when power supply is started and gradually decreasing the driving power when the power supply is cut off.

According to an aspect of the present invention, there is provided a dimming buck type light emitting diode (LED) driving apparatus, including: a main switch controlling a driving current flowing into an LED by driving power; a current detector detecting a driving current flowing into the LED; a power level determination unit determining a level of the driving power; a dimming capacitor for dimming control; a dimming control unit controlling charging and discharging of the dimming capacitor according to a power level determination signal of the power level determination unit and an enable signal; a reset circuit unit generating a reset signal according to a detection voltage from the current detector and a voltage of the dimming capacitor; a pulse generation unit generating a pulse signal; and a latch set by the pulse signal of the pulse generation unit and reset by the reset signal of the reset circuit unit to generate a switching signal, and turning on and off the main switch using the switching signal.

The main switch may be a transistor including a first terminal connected with the LED, a second terminal connected to ground, and a third terminal connected to an output terminal of the latch.

The power level determination unit may output a logic-high power level determination signal to the dimming control unit if the driving power is lower than a preset reference power voltage, and output a logic-low power level determination signal to the dimming control unit if the driving power is the same as or higher than the preset reference power voltage.

The dimming control unit may control charging of the dimming capacitor if power is determined to be normal in an enable state on the basis of a power level determination signal of the power level determination unit and an enable signal, and control discharging of the dimming capacitor if the power is determined to be abnormal in the enable state on the basis of the power level determination signal of the power level determination unit and the enable signal.

The dimming control unit may include: a zener diode connected in parallel with the dimming capacitor; a current source connected to driving power; a charge switch connected between the current source and a connection node between the dimming capacitor and the zener diode to provide a charging path of the dimming capacitor; a current sink connected to ground; a discharge switch connected between the connection node and the current sink to provide a discharging path of the dimming capacitor; a switching control logic performing a logic AND operation on the enable signal and the power level determination signal to output a first switching signal to the charge switch and output a second switching signal phase-inverted from the first switching signal to the discharge switch; and a comparator outputting a soft shut-down signal if a voltage of the dimming capacitor is lower than a preset first reference voltage.

The dimming control unit may further include a sub-switch connected in parallel with the zener diode and turned on and off according to the power level determination signal.

The switching control logic may include: a first inverter inverting the power level determination signal; an AND gate performing a logic AND operation on the enable signal and the power level determination signal to generate the first switching signal, and outputting the first switching signal to the charge switch; and a second inverter inverting the first switching signal of the AND gate to generate the second switching signal, and outputting the second switching signal to the discharge switch.

The reset circuit unit may generate a reset signal if a detection voltage from the current detector is higher than a voltage of the dimming capacitor or a second reference voltage.

The reset circuit unit may include: a first comparator including a first non-inversion terminal receiving the detection voltage from the current detector, a first inversion terminal receiving a voltage of the dimming capacitor and a first output terminal comparing the voltage of the dimming capacitor with the detection voltage to output a first comparison result signal; a second comparator including a second non-inversion terminal receiving the detection voltage from the current detector, a second inversion terminal receiving the second reference voltage, and a second output terminal comparing the second reference voltage with the detection voltage to output a second comparison result signal; and an OR gate performing a logic OR operation on the first comparison result signal of the first comparator and the second comparison result signal of the second comparator to output a resultant signal of the logic OR operation to a reset terminal of the latch.

The switching signal of the latch has a pulse width from a rising edge of the pulse signal of the pulse generation unit to a rising edge of the reset signal.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE PREFERRED EMBODIMENT

Figure 1:
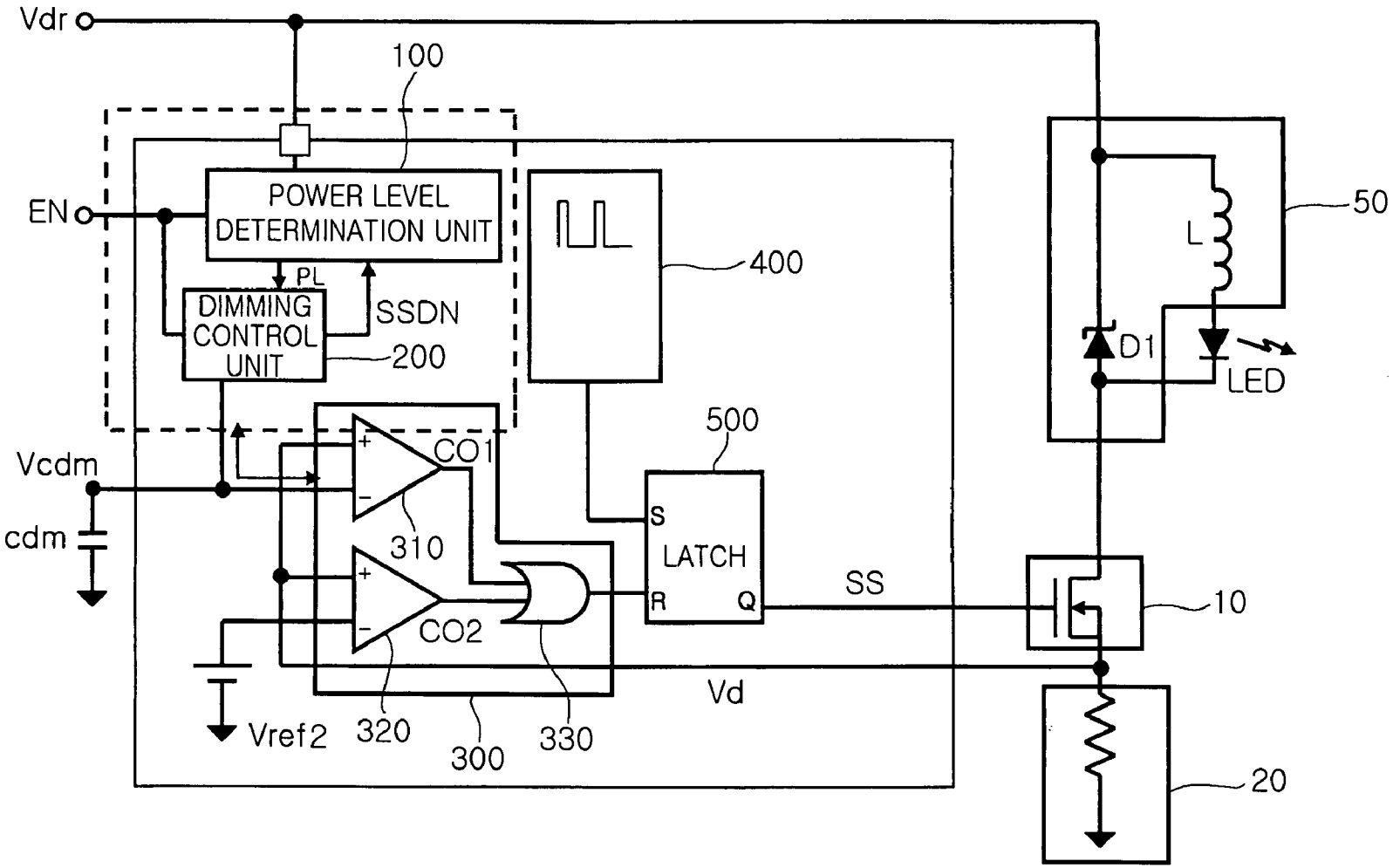
FIG. 1 is a view illustrating a configuration of a dimming buck type LED driving apparatus according to an embodiment of the present invention.

Exemplary embodiments of the present invention will be described below in more detail with reference to the accompanying drawings. The present invention may, however, be embodied in different forms and should not be constructed as limited to the embodiments set forth herein. Rather, these embodiments are provided so that this disclosure will be thorough and complete, and will fully convey the scope of the present invention to those skilled in the art. Like reference numerals refer to like elements throughout.

FIG. 1 illustrates a configuration of a dimming buck type light emitting diode (LED) driving apparatus according to an embodiment of the present invention.

Referring to FIG. 1, the dimming buck type LED driving apparatus according to the embodiment of the present invention includes a main switch 10, a current detector 20, a power level determination unit 100, a dimming capacitor Cdm, a dimming control unit 200, a reset circuit unit 300, a pulse generation unit 400, and a latch 500. The main switch 10 turns on and off a driving current flowing into the LED by driving power Vdr. The current detector 20 detects the driving current flowing into the LED. The power level determination unit 100 determines a level of the driving power Vdr. The dimming capacitor Cdm is used for dimming control. The dimming control unit 200 controls charging and discharging of the dimming capacitor Cdm according to a power level determination signal (hereinafter, also referred to as a PL signal) PL of the power level determination unit 100 and an enable signal. The reset circuit unit 300 generates a reset signal according to a detection voltage Vd from the current detector 20 and a voltage Vcdm of the dimming capacitor Cdm. The pulse generation unit 400 generates a pulse signal. The latch 500 is set by a pulse signal of the pulse generation unit 400 and reset by a reset signal of the reset circuit unit 300 to generate a switching signal SS, and switches the main switch 10 using the switching signal SS.

The main switch 10 may be a transistor including a first terminal connected to the LED, a second terminal connected to ground, and a third terminal connected to an output terminal of the lath unit 500. Specifically, the transistor may be an N-channel MOS transistor in which the first terminal, the second terminal and the third terminal are a drain, a source and a gate, respectively.

The power level determination unit 100 outputs a logic-high PL signal PL to the dimming control unit 200 if the driving power Vdr is lower than a preset reference power voltage. If not, the power level determination unit 100 outputs a logic-low PL signal PL to the dimming control unit 200.

The dimming control unit 200 controls charging of the dimming capacitor Cdm if power is determined to be normal in an enable state on the basis of the PL signal PL of the power level determination unit 100 and an enable signal EN. Also, if the power is determined to be abnormal in the enable state, the dimming control unit 200 controls discharging of the dimming capacitor Cdm.

In FIG. 1, a reference numeral 50 indicates a protection circuit unit for protecting the LED. The protection circuit unit 50 may include a zener diode D1 and a coil L.

Figure 2:
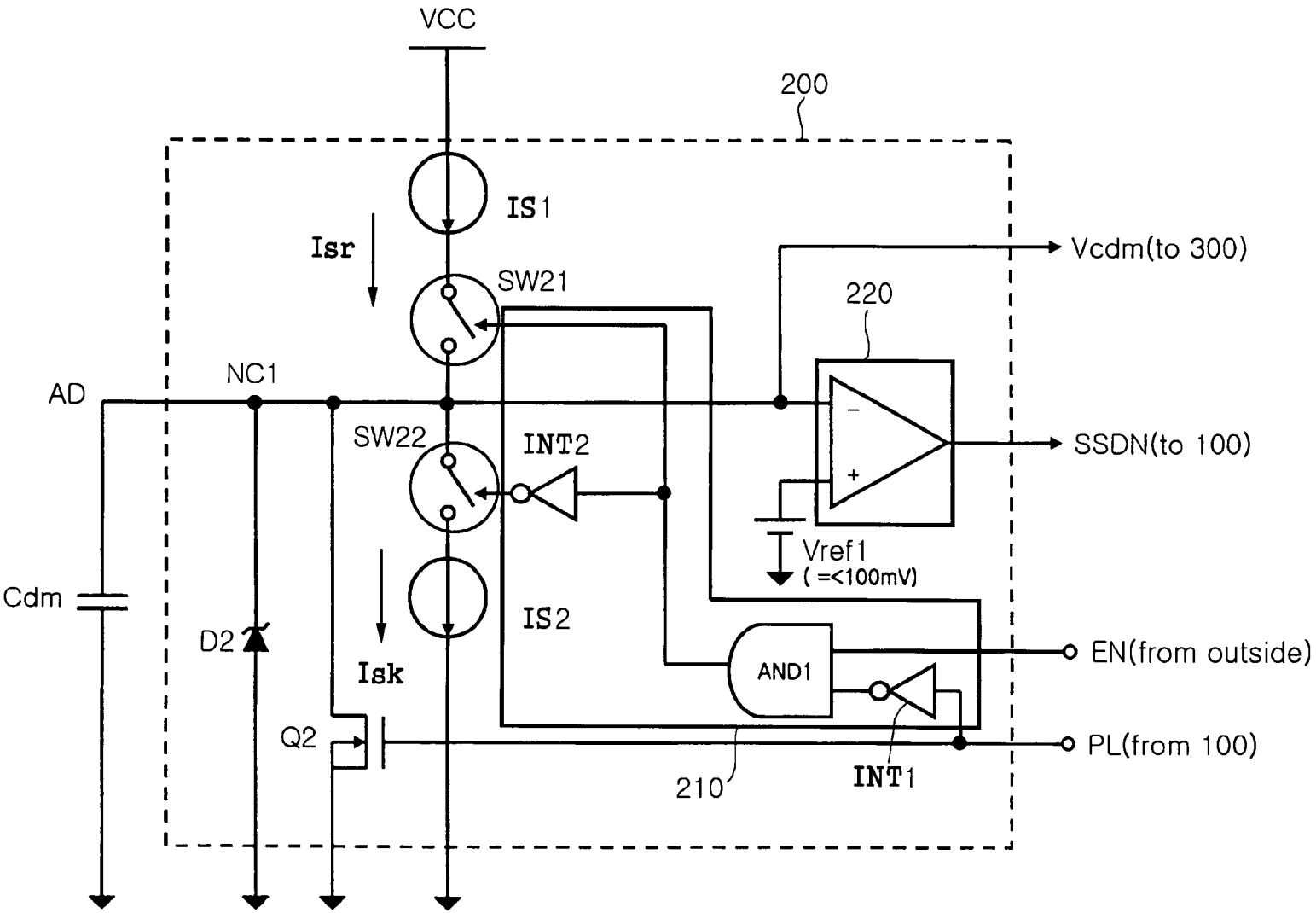
FIG. 2 is a circuit diagram of a dimming controller according to an embodiment of the present invention.

FIG. 2 is a circuit diagram of the dimming control unit 200 according to an embodiment of the present invention. Referring to FIG. 2, the dimming control unit 200 includes a zener diode D2, a current source IS1, a charge switch SW21, a current sink IS2, a discharge switch SW22, a switching control logic 210, and a comparator 220. The zener diode D2 is connected in parallel with the dimming capacitor Cdm. The current source IS1 is connected to driving power Vcc. The charge switch SW21 is connected between the current source IS1 and a connection node NC1 between the dimming capacitor Cdm and the zener diode D2, and thus provides a charging path of the dimming capacitor Cdm. The current sink IS2 is connected to ground. The discharge switch SW22 is connected between the connection node NC1 and the current sink IS2, and thus provides a discharging path of the dimming capacitor Cdm. The switching control logic 210 performs a logic AND operation on the enable signal EN and an inverted signal of the PL signal PL to output a first switching signal to the charge switch SW21 and output a second switching signal phase-inverted from the first switching signal to the discharge switch SW22. A comparator 220 outputs a soft shutdown signal SSDN if a voltage Vcdm of the dimming capacitor Cdm is lower than a preset first reference voltage Vref1.

The dimming control unit 200 may further include a sub-switch Q2 connected in parallel with the zener diode D2 and turned on and off according to the PL signal PL.

The switching control logic 210 includes a first inverter INT1, an AND gate AND1, and a second inverter INT2. The first inverter INT1 inverts the PL signal PL. The AND gate AND1 performs a logic AND operation on the enable signal EN and an inverted signal of the PL signal PL to generate the first switching signal, and outputs the first switching signal to the charge switch SW21. The second inverter INT2 inverts the first switching signal of the AND gate AND1 to generate the second switching signal, and outputs the second switching signal to the discharge switch SW22.

The reset circuit unit 300 generates a reset signal if a detection voltage Vd from the current detector 20 is higher than the voltage Vcdm of the dimming capacitor Cdm or a second reference voltage Vref2.

Specifically, the reset circuit unit 300 includes a first comparator 310, a second comparator 320, and an OR gate 330. The first comparator 310 includes a first non-inversion terminal receiving a detection voltage Vd from the current detector 20, a first inversion terminal receiving a voltage Vcdm of the dimming capacitor Cdm, and a first output terminal comparing the voltage Vcdm of the dimming capacitor Cdm with the detection voltage Vd to output a first comparison-result signal CO1. The second comparator 320 includes a second non-inversion terminal receiving the detection voltage Vd from the current detector 20, a second inversion terminal receiving the second reference voltage Vref2, and a second output terminal comparing the second reference voltage Vref2 with the detection voltage Vd to output a second comparison-result signal CO2. The OR gate 330 performs a logic OR operation on the first comparison-result signal CO1 of the first comparator 310 and the second comparison-result signal CO2 of the second comparator 320 to output a resultant signal of the OR operation to a reset terminal of the latch 500.

A switching signal of the latch 500 may have a pulse width from a rising edge of a pulse signal of the pulse generation unit 400 to a rising edge of the reset signal.

Figure 3:
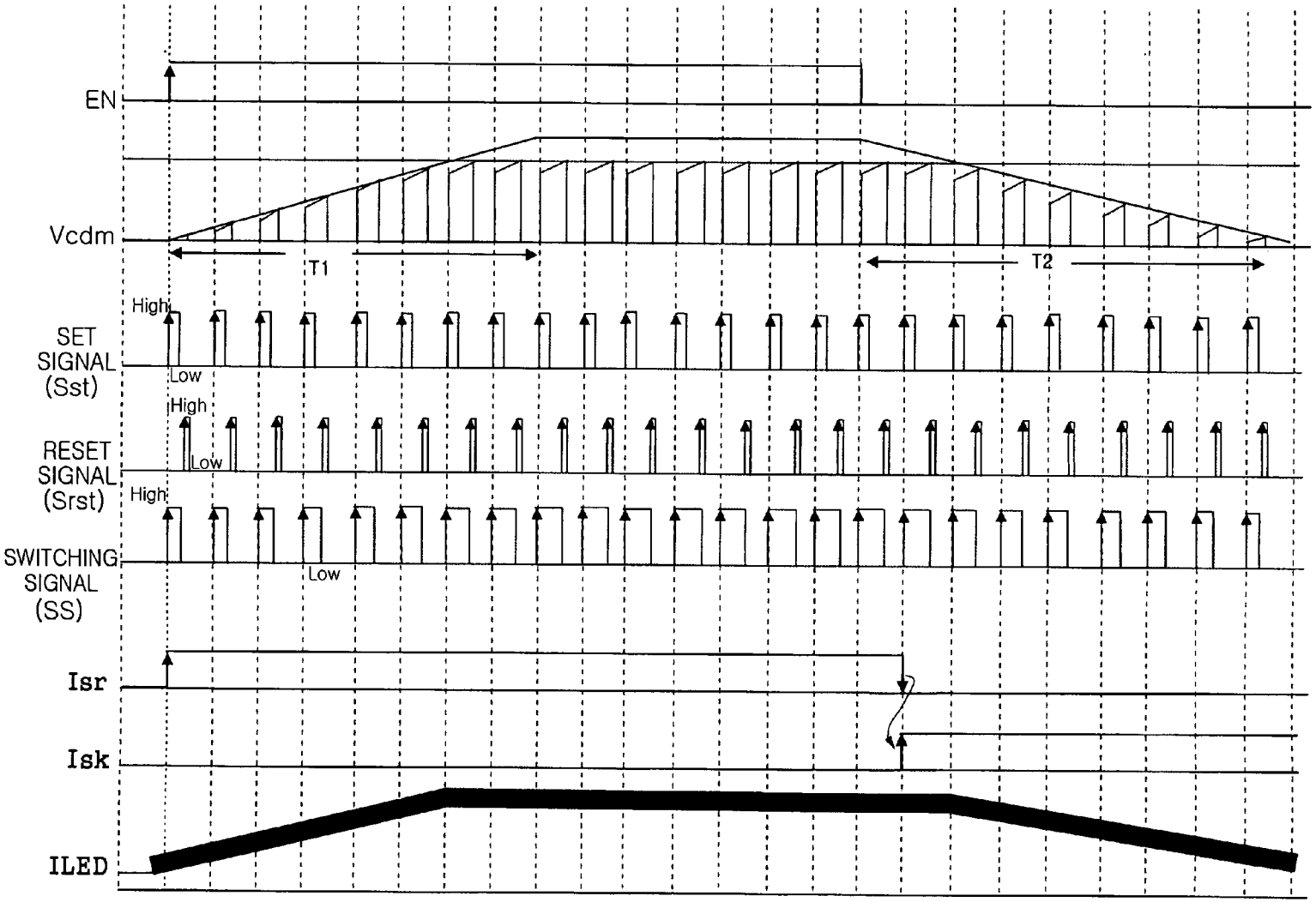
FIG. 3 is a timing diagram of a dimming buck type LED driving apparatus according to an embodiment of the present invention.

FIG. 3 is a timing diagram of the LED driving apparatus according to an embodiment of the present invention. In FIG. 3, En denotes an enable signal, Vcdm denotes a voltage of a dimming capacitor, Sst denotes a set signal, Srst denotes a reset signal, SS denotes a switching signal, Isr denotes a current of a current source IS1, Isk denotes a current of a current sink IS2, and ILED denotes a current flowing into an LED.

Operations and effects according to the embodiment of the present invention will now be described in more detail with reference to accompanying drawings. An operation of the dimming buck-type LED driving apparatus according to the embodiment of the present invention will be described with reference to FIGS. 1 through 3. In FIG. 1, when a system employing the dimming buck-type LED driving apparatus according to the embodiment of the present invention is turned on, driving power Vdr is supplied and simultaneously an enable signal EN is input.

Then, the power level determination unit 100 determines a level of the driving power Vdr to output a power level determination signal (i.e., PL signal) PL to the dimming control unit 200.

For example, the power level determination unit 100 outputs a logic-high PL signal PL to the dimming control unit 200 if the driving power Vdr is lower than a preset reference power voltage. If not, the power level determination unit 100 outputs a logic-low PL signal PL to the dimming control unit 200.

The dimming capacitor Cdm according to the embodiment of the present invention is charged or discharged for dimming control under the control of the dimming control unit 200

The dimming control unit 200 controls charging and discharging of the dimming capacitor Cdm according to the PL signal PL of the power level determination unit 100 and an enable signal. Thus, under the control of the dimming control unit 200, the dimming capacitor Cdm is charged with the voltage Vcdm or discharged as shown in FIG. 3.

The driving power Vdr according to the embodiment of the present invention is supplied to the LED, and thus a driving current flows into the LED. Here, the main switch 10 turns on and off the driving current flowing into in the LED by the driving power Vdr in response to a switching signal SS.

In this operation, the current detector 20 according to the embodiment of the present invention detects the driving current flowing into the LED, and outputs a detection result to the reset circuit unit 300. Also, the pulse generation unit 400 according to the embodiment of the present invention generates a pulse signal.

Referring to FIGS. 1 through 3, the reset circuit unit 300 generates a reset signal Srst according to the detection voltage Vd from the current detector 20 and the voltage Vcdm of the dimming capacitor Cdm, and outputs the reset signal Srst to the latch 500.

The latch 500 is set by the pulse signal of the pulse generation unit 400 and reset by the reset signal Srst of the reset circuit unit 300, thereby generating the switching signal SS as shown in FIG. 3. The latch 500 turns on and off the main switch 10 using the switching signal SS.

Assuming that the main switch 10 is an N-channel MOS transistor including a drain connected to the LED, a source connected to ground and a gate connected to an output terminal of the latch 500, if the switching signal SS is at a logic high level, the main switch 10 is turned on for a duration of the logic high level of the switching signal SS. In contrast, if the switching signal SS is at a logic low level, the main switch 10 is turned off for a duration of the logic low level of the switching signal SS.

Hereinafter, the dimming control unit 200 will be described in detail. The dimming control unit 200 controls charging of the dimming capacitor Cdm if power is determined to be normal in an enable state on the basis of the PL signal PL of the power level determination unit 100 and the enable signal EN. If the power is determined to be abnormal in the enable state, the dimming control unit 200 controls discharging of the dimming capacitor Cdm.

Referring to FIGS. 1 and 2, the switching control logic 210 of the dimming control unit 200 performs a logic AND operation on the enable signal EN and an inverted signal of the PL signal PL to output a first switching signal to the charge switch SW21 and output a second switching signal phase-inverted from the first switching signal to the discharge switch SW22.

That is, if the enable signal En is at a logic high level and the PL signal PL is at a logic low level, the charge switch SW21 is turned on by the first switching signal and the discharge switch SW22 is turned off. When the charge switch SW21 is turned on, a current Isr of the current source IS1 flows into the dimming capacitor Cdm, thereby charging the dimming capacitor Cdm. Because of the zener diode D2, the charged voltage of the dimming capacitor Cdm does not exceed a predetermined voltage level.

In contrast, if the enable signal EN is at a logic high level and the PL signal PL is at a logic high level, the discharge switch SW22 is turned on by the second switching signal, and the charge switch SW21 is turned off. When the discharge switch SW22 is turned on, the charged voltage of the dimming capacitor Cdm is quickly discharged to ground as the current Isk of the current sink IS2 flows to ground.

As shown in FIG. 3, because of the current Isr of the current source IS1 and the current Isk of the current sink IS2, the LED is gradually turned on, maintained at a predetermined level and then gradually turned off. Accordingly, the LED can be gradually turned on and off as in lighting in theater.

The comparator 220 of the dimming control unit 200 outputs a soft shut-down signal SSDM to the power level determination unit 100 if the voltage Vcdm of the dimming capacitor Cdm is lower than a preset first reference voltage Vref1.

Also, if the dimming control unit 200 includes the sub-switch Q2 connected in parallel with the zener diode D2, the sub-switch Q2 is turned on and off according to the PL signal PL, so that the voltage Vcdm of the dimming capacitor Cdm can be discharged more quickly.

The switching control logic 210 will now be described in more detail with reference to FIGS. 1 and 2. The first inverter INT1 of the switching control logic 210 inverts the PL signal PL. The AND gate AND1 of the switching control logic 210 performs a logic AND operation on the enable signal En and an inverted signal of the PL signal PL to generate the first switching signal, and outputs the first switching signal to the charge switch SW21.

The second inverter INT2 of the switching control logic 210 inverts the first switching signal of the AND gate AND1 to generate the second switching signal, and outputs the second switching signal to the discharge switch SW22.

The reset circuit unit 300 generates a reset signal if the detection voltage Vd from the current detector 20 is higher than voltage Vcdm of the dimming capacitor Cdm or the second reference voltage Vref2. This will now be described with reference to FIGS. 1 and 2.

Referring to FIGS. 1 and 2, the reset circuit unit 300 includes the first comparator 310, the second comparator 320 and the OR gate 330. The first comparator 310 compares the voltage Vcdm of the dimming capacitor Cdm input through the first inversion terminal with the detection voltage Vd input through the first non-inversion terminal, thereby outputting a first comparison result signal CO1. The second comparator 320 compares the first reference voltage Vref1 input through the second inversion terminal with the detection voltage Vd input through the second non-inversion terminal, thereby outputting a second comparison result signal CO2.

The OR gate 330 of the reset circuit unit 300 performs a logic OR operation on the first comparison result signal CO1 of the first comparator 310 and the second comparison result signal CO2 of the second comparator 320, thereby outputting a resultant signal of the logic Or operation to the reset terminal of the latch 500.

A switching signal of the latch 500 may have a pulse width from a rising edge of the pulse signal of the pulse generator 400 to a rising edge of the reset signal. As shown in FIG. 3, A pulse width of an output signal of the latch 500 gradually increases while a source current Isr flows, and gradually decreases while a sink current Isk flows.

By the dimming control unit 200 according to the embodiment of the present invention, the LED can be gradually turned on by the time it takes to charge the dimming capacitor Cdm. The LED can also be gradually turned off by the time it takes to discharge the dimming capacitor Cdm. Consequently, the LED can be gradually turned on and off as in lighting in theater.

The dimming buck type LED driving apparatus according to the embodiments of the present invention can realize a dimming function of the LED by gradually increasing driving power when power supply is started and gradually decreasing driving power when the power supply is cut off.

While the present invention has been shown and described in connection with the exemplary embodiments, it will be apparent to those skilled in the art that modifications and variations can be made without departing from the spirit and scope of the invention as defined by the appended claims.

What is claimed is:

1. A dimming buck type light emitting diode (LED) driving apparatus, comprising:

a main switch controlling a driving current flowing into an LED by driving power;

a current detector detecting a driving current flowing into the LED;

a power level determination unit determining a level of the driving power;

a dimming capacitor for dimming control;

a dimming control unit controlling charging and discharging of the dimming capacitor according to a power level determination signal of the power level determination unit and an enable signal;

a reset circuit unit generating a reset signal according to a detection voltage from the current detector and a voltage of the dimming capacitor;

a pulse generation unit generating a pulse signal; and a latch set by the pulse signal of the pulse generation unit and reset by the reset signal of the reset circuit unit to generate a switching signal, and turning on and off the main switch using the switching signal.

2. The dimming buck type LED driving apparatus of claim 1, wherein the main switch is a transistor comprising a first terminal connected with the LED, a second terminal connected to ground, and a third terminal connected to an output terminal of the latch.

3. The dimming buck type LED driving apparatus of claim 1, wherein the power level determination unit outputs a logic-high power level determination signal to the dimming control unit if the driving power is lower than a preset reference power voltage, and outputs a logic-low power level determination signal to the dimming control unit if the driving power is the same as or higher than the preset reference power voltage.

4. The dimming buck type LED driving apparatus of claim 1, wherein the dimming control unit controls charging of the dimming capacitor if power is determined to be normal in an enable state on the basis of a power level determination signal of the power level determination unit and an enable signal, and controls discharging of the dimming capacitor if the power is determined to be abnormal in the enable state on the basis of the power level determination signal of the power level determination unit and the enable signal.

5. The dimming buck type LED driving apparatus of claim 4, wherein the dimming control unit comprises:

a zener diode connected in parallel with the dimming capacitor;

a current source connected to driving power;

a charge switch connected between the current source and a connection node between the dimming capacitor and the zener diode to provide a charging path of the dimming capacitor;

a current sink connected to ground;

a discharge switch connected between the connection node and the current sink to provide a discharging path of the dimming capacitor;

a switching control logic performing a logic AND operation on the enable signal and the power level determination signal to output a first switching signal to the charge switch and output a second switching signal phase-inverted from the first switching signal to the discharge switch; and a comparator outputting a soft shut-down signal if a voltage of the dimming capacitor is lower than a preset first reference voltage.

6. The dimming buck type LED driving apparatus of claim 5, wherein the dimming control unit further comprises a sub-switch connected in parallel with the zener diode and turned on and off according to the power level determination signal.

7. The dimming buck type LED driving apparatus of claim 5, wherein the switching control logic comprises:

a first inverter inverting the power level determination signal;

an AND gate performing a logic AND operation on the enable signal and the power level determination signal to generate the first switching signal, and outputting the first switching signal to the charge switch; and a second inverter inverting the first switching signal of the AND gate to generate the second switching signal, and outputting the second switching signal to the discharge switch.

8. The dimming buck type LED driving apparatus of claim 1, wherein the reset circuit unit generates a reset signal if a detection voltage from the current detector is higher than a voltage of the dimming capacitor or a second reference voltage.

9. The dimming buck type LED driving apparatus of claim 8, wherein the reset circuit unit comprises:

a first comparator comprising a first non-inversion terminal receiving the detection voltage from the current detector, a first inversion terminal receiving a voltage of the dimming capacitor and a first output terminal comparing the voltage of the dimming capacitor with the detection voltage to output a first comparison result signal;

a second comparator comprising a second non-inversion terminal receiving the detection voltage from the current detector, a second inversion terminal receiving the second reference voltage, and a second output terminal comparing the second reference voltage with the detection voltage to output a second comparison result signal; and an OR gate performing a logic OR operation on the first comparison result signal of the first comparator and the second comparison result signal of the second comparator to output a resultant signal of the logic OR operation to a reset terminal of the latch.

10. The dimming buck type LED driving apparatus of claim 1, wherein the switching signal of the latch has a pulse width from a rising edge of the pulse signal of the pulse generation unit to a rising edge of the reset signal.

* * * * *